US005151138A

United States Patent [19]

Lownds

[11] Patent Number: 5,151,138

[45] Date of Patent: Sep. 29, 1992

[54] BLASTING COMPOSITION AND METHOD

[75] Inventor: Charles M. Lownds, Johannesburg, South Africa

[73] Assignee: Mining Services International Corp., Salt Lake City, Utah

[21] Appl. No.: 675,142

[22] Filed: Mar. 26, 1991

[51] Int. Cl.[5] ..... C06G 45/02

[52] U.S. Cl. ..... 149/21; 149/46; 149/61; 149/112

[58] Field of Search ..... 149/112, 21, 46, 61

[56] References Cited

U.S. PATENT DOCUMENTS 4,619,721 10/1986 Cescon et al. ..... 149/21

4,714,503 12/1987 Cescon et al. ..... 149/21

*Primary Examiner*—Stephen J. Lechert, Jr.

*Attorney, Agent, or Firm*—Ladas & Parry

[57] ABSTRACT

A blasting composition for use in boreholes of diameter not less than 80 mm. The composition contains more than about 25% of solid oxidiser particles such as limestone ammonium nitrate. These particles are in the form of dense prills, granules or crystals and about 80% of them have a minimum thickness in the range of 1/200 to 1/75 of borehole diameter.

12 Claims, No Drawings

BLASTING COMPOSITION AND METHOD

BACKGROUND OF THE INVENTION

This invention relates to explosives for use in mining, both packaged and bulk explosives, which are not cap sensitive and are commonly called blasting agents. In particular, this invention relates to blasting agents containing particulate solid oxidiser materials of selected particle size.

Bulk blasting agents which are well known in the art include ANFO (a mixture of ammonium nitrate prills and fuel oil), blends of ammonium nitrate or ANFO with an emulsion phase, called Heavy ANFO, emulsion explosives (which sometimes contain some solid oxidiser), and water-gel or slurry explosives. Most of these blasting agents contain solid oxidisers, most commonly ammonium nitrate, which is added as a discrete phase or which results from the crystallisation of nitrates from the aqueous phase when a slurry explosive is prepared hot and allowed to cool before firing.

All the above bulk blasting agents are used in packaged form as well, with the composition being suitably modified. Explosives used in smaller diameters require increased sensitivity, and this can be achieved by the addition of chemical sensitisers, such as mono-methylamine nitrate, ammonium perchlorate and others. In order to ensure adequate shelf life, formulators of packaged explosives commonly include glass micro-balloons, instead of chemical gassing, and use waxes instead of oils in emulsion explosives. Packaged explosives nevertheless often contain solid nitrates which are added into the composition or arise from crystallisation during cooling.

The behavior of solid oxidisers in explosives has an important bearing on their detonation characteristics and on their rock breaking performance. It is well known that solid oxidisers of smaller particle size lead to higher detonation velocity of the explosive, because such finely-divided oxidiser is able to react completely, or almost completely in the detonation reaction zone. Solid oxidisers of larger particle size react only partially in the detonation reaction zone, which results in a lower velocity of detonation. Ingredients in an explosive composition which do not react in the detonation reaction zone nevertheless continue to react and release their energy. Depending on the time-scale of such energy release, it may or may not contribute to the useful work in fracturing, dislodging and moving the rock.

Solid oxidisers for use in blasting agents are selected for various reasons. Ammonium nitrate (AN) is an economical, widely available and energetic oxidiser. In porous prill form, AN absorbs fuel oil to form an effective explosive. The particle size of the prills is typically about 2 mm, but the prill structure is an open or porous lattice of micro-crystals. This ensures intimate mixing of fuel and oxidises and leads to effective shock heating and subsequent reaction at many points within the porous prills. In terms of reactivity, therefore, the particle size of porous prills is effectively much less than the prill diameter.

Solid oxidisers in the form of dense prills, granules or crystals are normally used either in the size range of greatest availability, or are used in the most finely-divided form which can be practically achieved. The use of fine solids is to ensure a high velocity of detonation in the explosive. Sometimes solid oxidisers are selected for their effects on rheology or on product density. Fine solids have a drying effect on liquid/solid systems, and this can be disadvantageous, e.g. in packaged explosives.

Solid oxidisers are therefore commonly selected for reasons of availability, cost, to maximise the velocity of detonation, for their effect on the rheology of a composition, etc. Formulators of explosives choose the most finely-divided form of solid oxidiser available, porous ammonium nitrate being a case in point, provided that some other property of the composition is not adversely affected.

SUMMARY OF THE INVENTION

We have found that improved blasting results can be achieved if solid oxidisers are selected according to the time-scale on which they react. Correct choice of particle size of solid oxidiser can ensure that little of its energy is released during the detonation reaction and during the creation of the shock wave in rock, while substantially all of the available energy is released during later, useful stages of the explosive/rock interaction. In certain types of blasting the creation of an intense shock wave in the ground is either not useful or harmful. For example, the ground shock wave can be responsible for damage to the sidewalls in the mine or to nearby structures. Alternatively, the explosive-induced shock wave is known to contribute to finer fragmentation of the rock; in many cases, the rock being blasted contains pre-existing joints and fractures, and little explosive-induced comminution is necessary. An explosive with a higher detonation velocity and therefore high peak borehole pressure which generates a high intensity shock wave in the rock will be wasting energy in such pre-fractured rocks.

Thus, according to the present invention, there is provided a blasting composition for use in boreholes of diameter not less than 80 mm which contains more than about 25% of a solid oxidiser particles in the form of dense prills, granules or crystals, and most of the solid oxidiser particles, i.e. at least about 80%, have a minimum thickness in the range of about 1/200 to about 1/75, preferably about 1/200 to about 1/100, of the borehole diameter.

DETAILED DESCRIPTION OF THE INVENTION

We have found improved blasting results in particular where there are on average many pre-existing fractures amongst the boreholes, in other words where the rock is heterogenous rather than homogeneous on the scale of the blast. This improved performance has been achieved by formulating a blasting agent to contain a substantial fraction of solid oxidiser of particle size large enough not to contribute to the detonation reaction, but small enough to be almost completely reacted within the time-scale of useful work by the explosive.

The time-scale of useful work scales approximately with the reduced burden (which is the square root of the burden times the spacing), and as an approximate general rule, the reduced burden is proportional to the borehole diameter. Thus, the time-scale of useful work done by the explosive in a borehole is nearly proportional to the borehole diameter. Dense solid oxidiser particles behave in explosives like propellant grains; they burn from the outside inward. Therefore, the time-scale of reaction of an oxidiser particle is proportional to its diameter.

The solid oxidiser is preferably ammonium nitrate. The solid oxidiser may also be dense prills or granules of a fertiliser grade of ammonium nitrate. Another fertiliser grade of ammonium nitrate, limestone ammonium nitrate, which contains about 20% of finely divided calcium carbonate, and is in the form of dense prills or granules, has been found to be a suitable dense oxidiser.

Other nitrates, specifically sodium nitrate and calcium nitrate are also available in the form of dense prills or granules, and are suitable candidates as solid oxidisers. Crystalline oxidisers are less commonly available because of their tendency to agglomerate, but crystalline ammonium or metal nitrates are suitable solid oxidisers.

Yet another source of dense solid oxidisers exists in modified porous ammonium nitrate prills. The addition of a relatively small amount of water or an aqueous solution of nitrates to porous prills of ammonium nitrate will effectively convert them to dense prills of about the same diameter. The high solubility and hydrophilic surface of ammonium nitrate ensures that water or an aqueous solution is rapidly drawn into the porous prill, replacing most of the internal void space with an aqueous solution of ammonium nitrate (and other salts that may have been used in the added solution). This method allows some or all of the porous prilled ammonium nitrate in an explosive composition to be readily converted to dense prills of about the same diameter.

The blasting composition may also contain an emulsion of the type used in Heavy ANFO explosives. When the blasting composition contains such an emulsion it will typically be provided in an amount of about 10 to about 75% by weight.

The composition will also generally contain effective amounts of porous prilled ammonium nitrate to achieve a desired sensitivity. The composition may contain a density reducing agent such as gas bubbles, glass microballons, perlite or polystyrene to achieve sensitisation or reduction bulk density of the composition.

I claim:

1. A blasting composition for use in boreholes of diameter not less than 80 mm which contains more than about 25% of solid oxidiser particles in the form of dense prills, granules or crystals and at least about 80% of the solid oxidiser particles having a minimum thickness in the range of about 1/200 to about 1/75 of the borehole diameter.

2. A blasting composition according to claim 1 wherein the solid oxidiser particles have a minimum thickness in the range of about 1/200 to about 1/100 of the borehole diameter.

3. A blasting composition according to claim 1 wherein the solid oxidiser particles are ammonium nitrate, sodium nitrate or calcium nitrate.

4. A blasting composition according to claim 1 wherein the solid oxidiser particles are limestone ammonium nitrate.

5. A blasting composition according to claim 1 further comprising an emulsion.

6. A blasting composition according to claim 5 wherein the emulsion is provided in an amount of about 10 to about 75% by weight of the composition.

7. A method of blasting comprising inserting into a borehole of a diameter not less than 80 mm, a blasting composition comprising more than about 25% solid oxidizer particles in the form of dense prills, granules or crystals, wherein at least about 80% of the solid oxidizer particles have a minimum thickness in the range of about 1/200 to about 1/75 of the borehole diameter.

8. A method according to claim 7 wherein the solid oxidizer particles have a minimum thickness in the range of about 1/200 to about 1/100 of the borehole diameter.

9. A method according to claim 7 wherein the solid oxidizer particles are ammonium nitrate, sodium nitrate or calcium nitrate.

10. A method according to claim 7 wherein the solid oxidizer particles are limestone ammonium nitrate.

11. A method according to claim 7 further comprising an emulsion.

12. A method according to claim 11 wherein the emulsion is provided in an amount of about 10 to about 75% by weight of the blasting composition.

* * * * *